US005339913A

United States Patent [19]

Rives

[11] Patent Number: 5,339,913

[45] Date of Patent: Aug. 23, 1994

[54] WELL ORIENTING TOOL AND METHOD OF USE

[76] Inventor: Allen K. Rives, 11831 Pebbleton, Houston, Tex. 77383

[21] Appl. No.: 927,290

[22] PCT Filed: Oct. 9, 1991

[86] PCT No.: PCT/US91/07222

§ 371 Date: Sep. 30, 1992

§ 102(e) Date: Sep. 30, 1992

[51] Int. Cl.[5] ..... E21B 17/07

[52] U.S. Cl. ..... 175/73; 175/322; 166/117.7

[58] Field of Search ..... 175/61, 73–76, 175/45, 321, 323, 322; 166/384, 237, 240, 330, 331, 117.7

[56] References Cited

U.S. PATENT DOCUMENTS

| | | | |
|---|---|---|---|
| 1,110,639 | 9/1914 | Moore | 166/117.7 |
| 2,955,177 | 12/1960 | LeBus, Sr. et al. | 166/240 |
| 3,912,014 | 10/1975 | Wetzel | 166/315 |
| 3,997,008 | 12/1976 | Kellner | 175/45 |
| 4,015,662 | 4/1977 | Cochran | 166/104 |
| 4,059,164 | 11/1977 | Farris | 175/73 |
| 4,256,179 | 3/1981 | Shillander | 166/237 |
| 4,286,676 | 9/1981 | Nguyen et al. | 175/74 |
| 4,456,080 | 6/1984 | Holbert | 175/61 |
| 4,463,814 | 8/1984 | Horstmeyer et al. | 175/45 |
| 4,597,454 | 7/1986 | Schoeffler | 175/61 |
| 4,662,458 | 5/1987 | Ho | 175/27 |
| 4,739,841 | 4/1988 | Das | 175/61 |
| 4,854,397 | 8/1989 | Warren et al. | 175/26 |
| 5,050,692 | 9/1991 | Beimgraben | 175/61 |
| 5,117,927 | 6/1992 | Askew | 175/61 |
| 5,139,094 | 8/1992 | Prevedel et al. | 175/73 |
| 5,163,521 | 11/1992 | Pustanyk et al. | 175/45 |

OTHER PUBLICATIONS

"Directional Drilling and Deviation Control", Applied Drilling Engineering, by Bourgoyne Jr., SPE. 1986.

*Primary Examiner*—Ramon S. Britts
*Assistant Examiner*—Frank S. Tsay
*Attorney, Agent, or Firm*—Jack W. Hayden

[57] ABSTRACT

A down hole well tool shown in the form of an orienting tool (OT) has mandrel (16) with helical grooves (16*a*) thereon and a tubular member (20) which telescopically receives the mandrel (16). Keys (22) on tubular member (22) engage in the grooves (16*a*). Mandrel (16) is connected with non rotatable coil tubing (T) and member (20) is connected to a bottom hole assembly (BHA) which may comprise a plurality of components or a single device to form a well tool. The orienting or rotating tool (OT) and down hole assembly (BHA) constitute an orienting assembly, for orienting or rotating a device such as a drill bit (13) to drill a deviated well bore, including a horizontal well bore, to a desired target area. Downhole instruments relay to the surface equipment (1) the azimuth, inclination and tool face of the directional drilling equipment.

76 Claims, 7 Drawing Sheets

WELL ORIENTING TOOL AND METHOD OF USE

STATEMENT OF THE PRIOR ART

So far as known to applicant, there are no prior art devices which enable non-rotatable drill string, such as coiled tubing, to be employed as drill string to drill directional, or deviated well bores, including horizontal well bores.

There are various types of directional drilling equipment well known to those skilled in the art of directional drilling that may be employed with a conventional rotary drill string formed of tubular members threadedly connected together to form the drill string which drill string is rotated by surface equipment of any well known type to drill a directional, or deviated well bore including a horizontal well bore. Down hole instruments, such as by way of example only, MWD (Measuring While Drilling), steering tools or gyroscopes, well known to those skilled in the art of directional drilling, are used to provide information in a form which is relayed to the earth's surface in any suitable manner, well known by those skilled in the art of directional drilling.

This information is interpreted in a manner well known by those skilled the art of directional drilling to show the direction of the well bore being drilled by the down hole motor and drill bit on the lower end of the drill string and to predict what change in position or orientation, if any, should be made in the down hole directional drilling equipment to assure that the down hole motor and drill bit on the lower end of the drill string will drill the well bore to the desired target area.

The orientation of the directional drilling equipment including the down hole motor and drill bit is presently accomplished by rotating the drill string by any suitable means such as tongs, or the like, at the earth's surface when the readings obtained from the instruments employed with the directional drilling equipment indicate the necessity to rotate the drill string to re-position the drill string in the well bore for re-orienting the down hole directional drilling equipment, including the down hole motor and drill bit on the lower end of the drill string so as to face the drill bit and down hole motor in the direction to continue drilling the well bore to assure that the well bore will hit a designated or desired target area.

The various types of down hole directional drilling equipment, surface and down hole instrumentation, surface equipment and software used to determine and dictate the orientation necessary for the drilling of a deviated well bore, including a horizontal well bore to a target area, is generally referred to as the steering system or guidance system for the drill bit.

The use of keys which engage in helical grooves in members in various devices is well known.

SUMMARY OF THE INVENTION

So far as known to applicant, it has been considered impossible to use a non-rotatable drill string to drill a deviated or horizontal well bore as there is, so far as known to applicant, no practical, economical way to D rotate the non-rotatable drill string to orient the down hole directional drilling equipment and instrumentation including the down hole motor and drill bit to drill the well bore in a desired direction. The present invention allows this to be accomplished in a relatively simple, inexpensive and quick manner.

The present invention overcomes the problems and obstacles heretofore presented in connection with employing coil tubing for performing operations in a well bore, particularly a deviated or horizontal well bore.

One object of the present invention is to provide a well tool assembly and method of use for down hole orienting and reorienting of a device in a well bore to accomplish a desired result.

An object of the present invention is to provide a down hole orienting tool for use with a non rotatable drill string to orient a drill bit to drill a well bore in a desired direction.

An object of the present invention is to provide apparatus for rotating a down hole device by a non-rotatable member.

A further object of the present invention is to provide method and apparatus for drilling a deviated or horizontal well bore to a predetermined target area or location employing coiled tubing as a non-rotatable drill string.

Yet a further object of the present invention is to provide apparatus for rotating and locking a down hole device in a predetermined, or desired, rotated relationship or manner by a non-rotatable drill string, which device can be employed for fishing for lost or stuck objects, drilling and other down hole operations in a well bore.

A still further object is to provide apparatus and method for down hole rotation and locking of a down hole motor and drill bit in one or more sequential desired rotated or oriented positions as may be necessary to drill a well bore in a desired direction.

A further object is to provide apparatus and method for down hole rotation of a down hole motor and drill bit to a desired position to drill a well bore in a desired direction and manner by a non-rotatable drill string with which they are connected..

An object is to provide apparatus and method for down hole rotation of a bottom hole assembly to a desired position relative to a non-rotatable well string with which the bottom hole assembly is connected.

An object is to provide apparatus and method for down hole rotation of a bottom hole assembly or device, locking the down hole assembly or device in such desired rotated position and reorienting the well tool assembly or device and relocking it in the reoriented position.

Another object of the invention is to substantially reduce the expenses involved in well bore operations by reducing the number of people, time and equipment employed in well bore operations.

Other objects and advantages of the present invention will become more readily apparent from a consideration of the following description and drawings.

DESCRIPTION OF THE PREFERRED EMBODIMENTS

The present invention will be described in detail, by way of example only, in connection with one type of operation in which the present invention is applicable and with one type of well string and bottom hole well tool assembly as it relates to drilling a well bore, shaft or other type of access opening to a predetermined subterranean location or target area by a non-rotatable drill string; however, it can be appreciated that the invention may be employed in other operations with other types of well strings, such as by way of example only, a rotary drill string or an operating string made up by lengths of tubular members secured together in any suitable manner. It may also be used or with any type of device, or with other types of bottom hole assembly. Also, the components identified as comprising a down hole directional drilling assembly which may be used with the orienting tool form of this invention are by way of example only, and are not intended as a limitation.

Figures 1, 8:
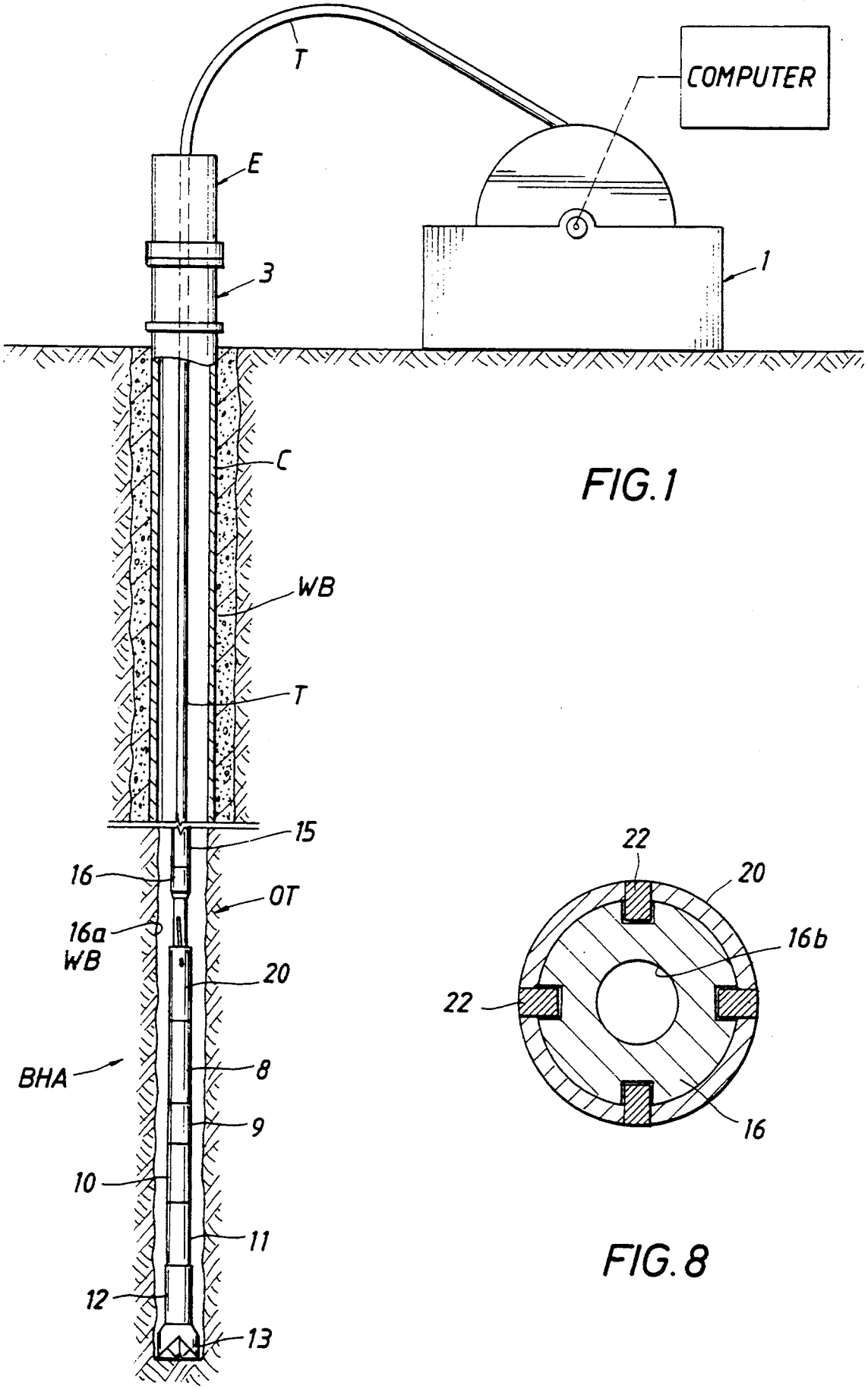
FIG. 1 is a schematic illustration of a well bore with coiled tubing extending therein and one form of a bottom hole assembly with which the present invention may be employed.
FIG. 8 is a sectional view on the line 8—8 of FIG. 5A.

Attention is first directed to FIG. 1 of the drawings wherein a coil tubing unit is referred to generally by the numeral 1 with coiled tubing T coiled on a drum and extending therefrom and through an Injector Head schematically represented at E, the construction and operation of which is well known to those skilled in the art, which is employed to force the coiled tubing T into and retrieve the coiled tubing T from a well bore WB in a well known manner. The Injector Head E is positioned on the well head that is connected to the upper end 3 of the casing C which extends into the well bore. The coiled tubing T extends downwardly into the well bore in the earth's surface as shown in the drawings.

In FIG. 1, one arrangement and use of the present invention is schematically illustrated with one form of a bottom hole assembly represented generally by the letters BHA in FIG. 1. The surface equipment to receive the information from the down hole instruments is shown schematically and referred to by the term Computer in Fig 1 of the drawings. Such equipment is well known and understood by those skilled in the art of its use.

A coiled tubing connecter represented by the numeral 15 is connected with the lower end of the coil tubing T. The bottom hole assembly includes tubular mandrel 16 which is threadedly connected to the connector 15, the tubular member 20 which telescopically receives the mandrel 16, and by way of example only, non-magnetic drill collar or collars represented at 8 threadedly secured to the tubular member 20, a mule shoe sub represented at 9, threadedly connected with the non-magnetic drill collars, a bent sub represented at 10 threadedly connected with the mule shoe sub, a fluid operated down hole motor or turbine 11 threadedly connected to the bent sub 10, a sub 12 threadedly connected to the motor and to drill bit 13.

Elements 8,9,10,11,12,13 above designated, along with the present invention when used as an orienting tool, generally referred to by the letters OT, which tool includes tubular mandrel 16 and tubular member 20, may be referred to as the bottom hole assembly BHA and it can be appreciated that the mandrel 16 and member 20, as above stated, may be employed with different components other than those above enumerated or in other situations. For example, where the present invention is to be employed as a fishing tool an overshot may be connected with the orienting tool OT and manipulated by rotation and longitudinal movement to telescopically engage a fish in the well bore. In other situations, the bottom hole assembly can be changed by those skilled in the art to include whatever components, tools or elements that may be necessary to accomplish the desired results for the particular purpose intended. Also, it may be used with other well string types for various operations.

The use and arrangement of non-magnetic drill collars, the mule shoe sub, a bent member, whether it is a bent sub or a bent motor housing, or both, a drill bit, the computer equipment at the earth's surface, the instruments and their location and connection with the directional down hole equipment and the surface computer equipment is well known to those skilled in the art of directional drilling including drilling deviated or horizontal well bores so that no detailed description is deemed necessary. Also, the instrumentation provides an indication of the inclination of the bottom hole assembly, its azimuth and the direction of the tool face. The direction of the bend of the bent sub or the bent housing is termed the tool face. This information is relayed to the computer at the earth's surface. By means of the foregoing equipment of the present invention, and with the determination of the azimuth, inclination and tool face provided by the instrumentation in the bottom hole assembly which is relayed to the earth's surface, by any suitable means such as electric conductor, formulas well known to those skilled in the art can be employed to determine the direction that the well bore has been been drilled and predict future direction of the well bore that the directional drilling assembly will take the bit unless it is changed.

Figure 2:
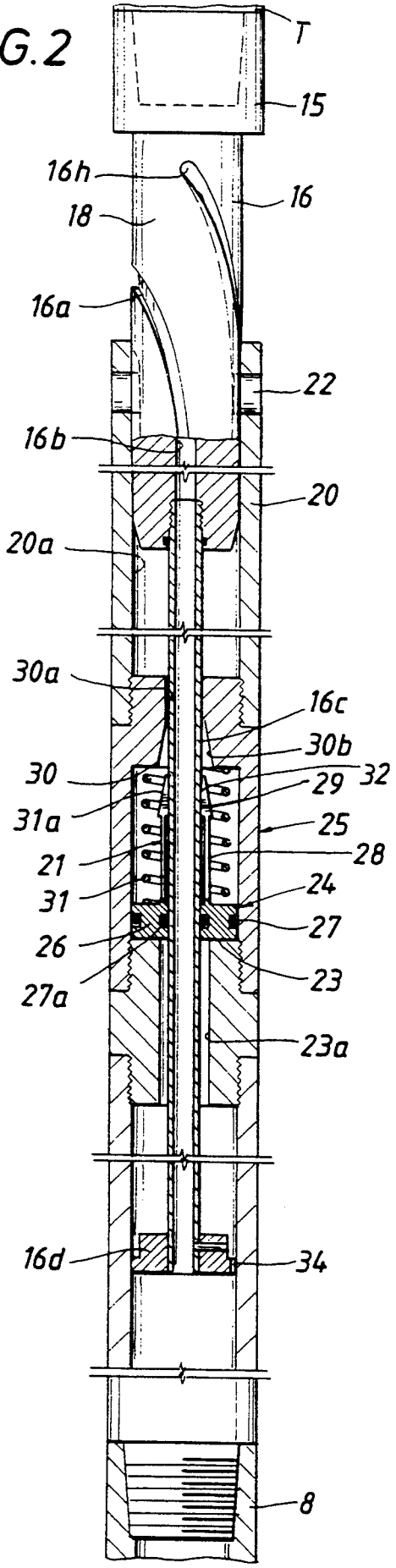
FIG. 2 is a sectional view of one form of the present invention illustrating it in its extended or open position and unlocked.
Figure 3:
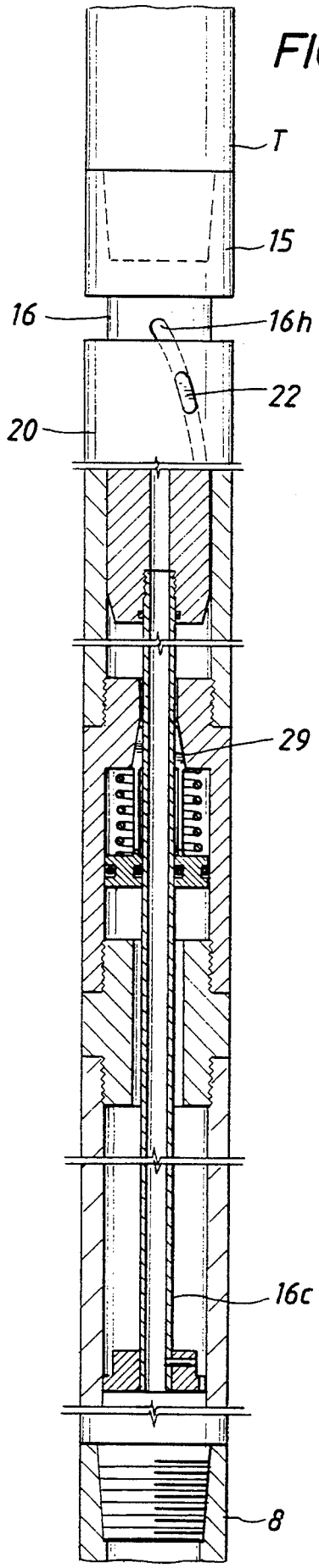
FIG. 3 is a sectional view similar to that of FIG. 2 but showing the present invention in a substantially closed or telescoped relationship and locked.

In FIGS. 2 and 3 one form of the invention when used as an orienting tool is illustrated. The non-rotatable coiled tubing T is connected at its lower end with a coiled tubing connector 15, the construction and use of which is well known to those skilled in the art of directional drilling. The connector is connected to rotator 16, shown in the form of a tubular mandrel with a bore 16*b* therethrough and having preferably a plurality of circumferentially spaced, longitudinally extending helical grooves 16*a* in its outer annular surface 18, four of which are shown in the drawings, by way of example. The rotatable tubular member 20 is provided with a longitudinal bore 20*a* for telescopically receiving the tubular mandrel 16 as shown in the drawings. Keys or projections 22 on the tubular member 20 project into the bore 20*a* of the tubular member to be received in the grooves 16*a* of the rotator 16 and when relative longitudinal movement occurs between the rotator or mandrel 16 and the member 20, rotation of the member 20 relative to the mandrel rotator 16 occurs.

The grooves 16*a* in the mandrel or rotator are of any suitable lead to accomplish whatever down hole function and result the device used with the orienting tool is intended to accomplish. In the example herein of drilling a deviated or horizontal well bore it is generally desirable that the grooves 16*a* in the rotator or mandrel have a lead of sufficient length so that at least one complete revolution of the member 20 may be effected by the mandrel or rotator 16. Preferably, a lead is used so that more than one revolution of the member 20 may be effected in order that the orienting tool may be recocked or manipulated down hole to provide any desired orientation from one oriented position to another when desired and as will be explained hereinafter.

Figure 4A:
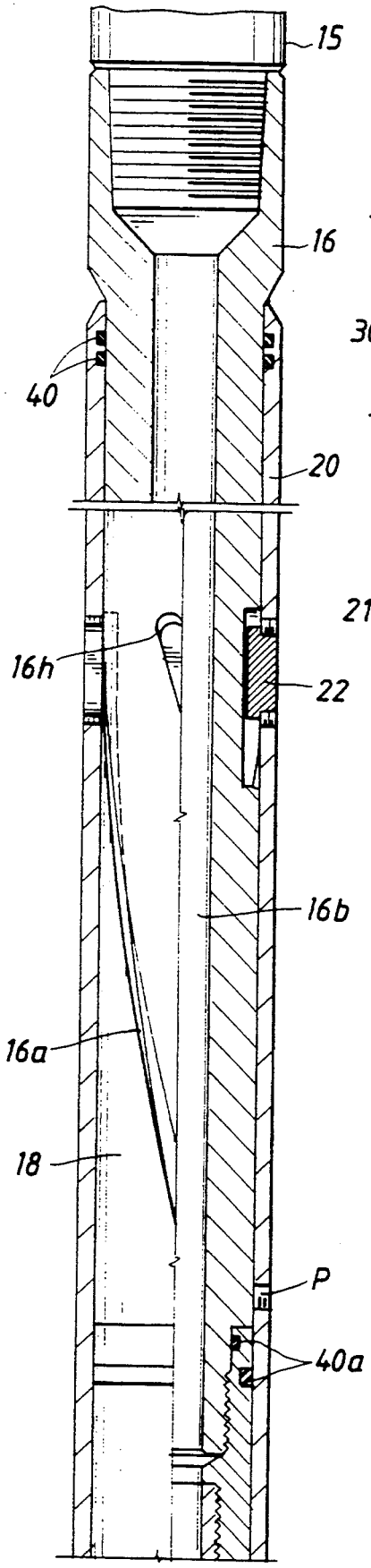
FIGS. 4A, 4B and 4C are continuation sectional views of another form of the present invention in closed or fully telescoped and unlocked position.

By way of example only, a lead of 30 inches for the grooves 16*a* is satisfactory which provides one and one quarter complete turns (450 degrees) of the tubular member 20 when rotator 16 is fully telescoped from fully closed position when the members 22 are immediately adjacent or contact the upper end 16*h* of helical grooves 16*a*, as shown in FIGS. 2 and 4A to fully extended position when the members 22 are immediately adjacent or contact the lower end of grooves 16*a*, or the reverse where mandrel 16 is initially fully extended out of member 20 and moved to fully closed position. This enables the mandrel or rotator 16 to effect more than one complete revolution of the tubular member 20 during orienting or rotation of the bottom hole assembly to accomplish the desired manipulation for orienting the bottom hole assembly to guide or direct the drilling of the well bore in the desired direction or manner.

By way of example only, assume that 360 degrees of rotation was required to attain an oriented position of North and that the mandrel of the orienting tool has been lowered into the member 20 to accomplish such oriented position. Assume that a new oriented position of South is required. Since South is 180 degrees from North, the member 20 cannot be rotated far enough by further lowering of the mandrel 16 into the member 20 to attain the desired orientation. It is therefore necessary to recock or open the orienting tool by removing some of the coil tubing from the well bore by means of the Injector Head at the earth's surface which will pull mandrel 16 up to extend it relative to member 20. When mandrel 16 is fully extended out of member 20, the orienting tool will be back at approximately North with 450 degrees again available for orientation purposes and a direction of South can now be accomplished by collapsing or lowering mandrel 16 into the member 20. This is accomplished by lowering the coil tubing by means of the Injector head which pushes, or collapses mandrel 16 into the member 20 until the desired new oriented position of South is attained.

After the rotatable tubular member 20 has been rotated by raising or lowering the coiled tubing to accomplish the desired orientation through rotation of member 20, the lock generally referred to by the numeral 25 is then actuated, as will be described hereinafter,to lock the mandrel or rotator 16 and the tubular member 20 together to maintain the bottom hole assembly including the drill bit, down hole motor and bent sub in the desired orientation or position during subsequent drilling operations.

The tubular mandrel or rotator 16 includes an extension 16*c* having a bore connected with the bore 16*b* to form a continuation of the bore 16*b*. In the FIGS. 2 and 3 form the extension is of smaller diameter with a smaller diameter bore than the portion of mandrel or rotator 16 in which it is connected. The lower end of the tubular mandrel portion 16*c* is provided with a centralizer 16*d* for maintaining alignment of the rotator 16 within the tubular member 20 during relative longitudinal movement between the mandrel 16 and member 20 in operation.

The location of the target area, in the example herein a subterranean target area to which a well bore is to be drilled, is provided to the operators at the earth's surface manning the computer equipment and those operating the drilling equipment and operations. From the instrumentation readings provided by the instruments in the bottom hole assembly which readings are relayed to the earth's surface by suitable means such as electrical cable (not shown) in the bore of the coiled tubing, the operators at the earth's surface can calculate and prescribe by formulas well known in their art how the bottom hole assembly including the bent sub, down hole motor and drill bit must be oriented or positioned to drill the well bore to hit the target area. If the bottom hole assembly including the drill bit and down hole motor require orienting from one position to another to face in a different direction, the lock 25 is released and the mandrel 16 and member 20 released from the slip segments. Then the coiled tubing is manipulated (pushed or pulled) to move the rotator or mandrel 16 longitudinally relative to the tubular member 20 and since the weight of the down hole assembly will normally maintain it in position, the mandrel will move in or out of the member 20 in response to longitudinal movement of the coil tubing to impart or provide the desired rotation of the down hole assembly and hence the desired orientation of the bent sub, down hole motor and drill bit. In some cases slight relative longitudinal movement of only a fraction of an inch is all that is required between the mandrel 16 and member 20.

With the mandrel 16 and tubular member 20 in unlocked relation, as shown in FIG. 1, raising or lowering of the coiled tubing T by the Injector Head E extends or telescopes, respectively, the mandrel or rotator 16 relative to the rotatable member 20 which rotates member 20 relative to the non-rotatable rotator or mandrel 16 and to the coiled tubing T connected to mandrel 16. This rotation changes the orientation of the bent sub, motor and drill bit to that dictated by the amount as calculated by the steering operator at the earth's surface from the the information relayed to the earth's surface by the instrumentation associated with the down hole assembly as being necessary to properly orient the bent sub, down hole motor and drill bit to drill the well bore into the target area.

It is then necessary to actuate the lock, referred to generally at 25 to releasably lock the mandrel 16 and tubular member 20 in their oriented relation to maintain the orientation during the subsequent drilling operation. The lock 25 includes piston means referred to generally at 24 which piston means has slip means referred to generally at 21 integrally formed thereon or secured thereon. Piston means 24 includes piston 26 having seals 27 and 27*a* for sealing between the piston and the inner surface of bore 20*a* and between the piston and the extension 16*c*, respectively, and in the form shown they are on the piston 26. A first shoulder 23 formed on the member 20 projects into the bore 20*a* as shown in FIG. 2 and this shoulder supports piston 26. An opening 23*a* extends longitudinally through the portion of the member 20 on which shoulder 23 is formed and the extension 16*c* extends there through and through an opening in the piston 26 as shown in the FIG. 2 form. The slip means 21 includes arms 28 extending from piston 26 with slip segments 29 on the arms 28. A second shoulder 30 in bore 20*a* is spaced longitudinally from first shoulder 23 and an opening 30*a* is provided in the second shoulder, as shown, for receiving extension 16*c* therethrough. An annular tapered surface portion 30*b* is formed in the opening 30*a* adjacent the second shoulder 30 for receiving the slip segments 29 as will be described. A spring 31 extends between the first shoulder 23 and the piston 26 to normally maintain slip means 21 in spaced relation to surface portion 34 and unlocked to assist in maintaining the mandrel 16 and the member 20 from prematurely engaging.

Increasing fluid pressure and volume in the coiled tubing causes it to act through the opening 34 in the centralizer 16*d* on extension 16*c* and through the opening 23*a* in first shoulder 23 to move piston 26 upwardly and collapse the spring 31 so that one side surface 31*a* of the arcuate slip segments 29 engages the annular tapered surface 30*b* on member 20 and another side surface 32 of the slip segments engage the outer surface of the extension 16*c* of the mandrel, as best illustrated in FIG. 3. This locks the mandrel 16 and rotatable member 20 in their relatively rotated, or oriented position during drilling operations. Drilling operations may then be initiated by supplying sufficient fluid pressure and volume through the coiled tubing, the mandrel 16, member 20 and the balance of the bottom hole assembly to impart rotation to the down hole motor 11 and the drill bit 13 in a manner well known to those skilled in the art to drill the well bore.

Drilling operations may be interrupted periodically such as, by way of example only, every 30 feet, and instrument readings taken and relayed to the earth's surface for calculation to see if further orientation of the bent sub, down hole motor and drill bit is required to assure that the target area will be hit by the well bore being drilled by the drill bit.

Since mandrel 16 member 20 are locked together when in a desired oriented position as illustrated in FIG. 3, lock 25 must be released and the orienting tool manipulated, if necessary, as will be described to assist the spring 31 in releasing slip segments 29 from the mandrel 16 and member 20. Longitudinal movement can then occur between mandrel 16 and member 20 to enable the mandrel 16 to effect further rotation of the member 20 by longitudinal movement of the coil tubing and mandrel 16 to effect rotation of the bottom hole assembly to reorient the bent sub, down hole motor and drill bit to steer the down hole motor and drill bit to drill the well bore in the direction desired.

If the present invention is near the vertical portion of the well bore, the lock 25 may be released by reducing the fluid pressure and volume, or shutting off the pumps, or compressors so that the spring force of spring 31 overcomes the fluid pressure acting on the piston 26 to unseat the slip segments 29 to enable the mandrel to be pulled up relative to the bottom hole assembly. In some situations it may be necessary to lower the coiled tubing to bump, or slightly tap, the drill bit on the bottom of the well bore and then pull up on the coiled tubing to release the mandrel 16 and the tubular member 20 from the slip segments. The mandrel 16 and the tubular member 20 can then be recocked or opened, (extended) relative to each other either by pulling on the coil tubing by the Injector Head E to lift or extend the grooved mandrel 16 out of the member 20 since member 20 will tend to maintain its position by reason of its weight and the weight of the bottom hole assembly and reorientation accomplished as above described.

Figure 9:
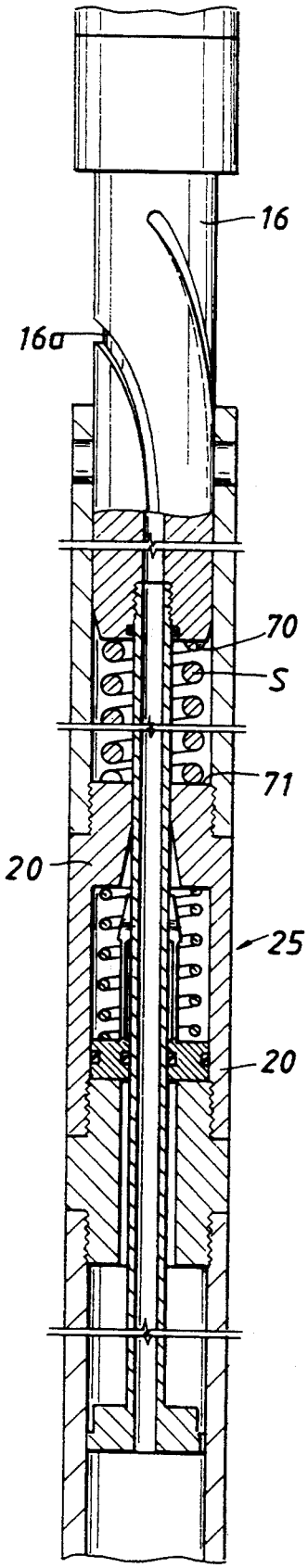
FIG. 9 is a sectional view of another form of the embodiment shown in FIGS. 2 and 3.

FIG. 9 illustrates an alternate form of the invention shown in FIGS. 2 and 3. A spring S is positioned between the mandrel or rotator 16 and the rotatable member 20 to assist in urging them apart after the lock 25 is released. The spring S assists in maintaining the rotator or mandrel 16 and rotatable member 20 in a longitudinal spaced relationship until relative longitudinal movement occurs therebetween which collapses or telescopes them together toward a closed position that overcomes the force in spring S. It also assists in enabling successive orientations to be accomplished in the well bore by the present invention in the manner as described herein. As shown in FIG. 9, the spring S is between shoulder 70 on the rotator 16 and a shoulder 71 on tubular member 20 so that when the rotator or mandrel 16 and the tubular member 20 are telescoped together or moved toward a closed position the force of spring 20 is overcome to collapse it until the desired oriented or rotated position of tubular member 20 is attained.

The assembly of the present invention is accomplished by connecting the instruments and down hole drilling components comprising the down hole assembly together and connecting the instruments with the cable conductor in the coiled tubing and connecting the mandrel 16 and tubular member 20 together along with the lock 25 to form the orienting tool. The mandrel 16 is connected with the connector 15 on the lower end of the coiled tubing and the tubular member with the adjacent component of the assembly, which in this example is the non-magnetic drill collars.

The coiled tubing is connected with a drilling fluid source of any suitable type which is well known to those skilled in the art of well drilling to circulate through the coiled tubing to perform various functions such as actuating the piston means to lock the mandrel 16 and member 20 together, circulate cuttings to the earth's surface, actuate the down hole motor to rotate the drill bit, and any other function for which the fluids may be normally employed in drilling operations.

The well tool assembly is lowered into the well bore, which may be a previously drilled well bore or a partially drilled well bore to receive the coiled tubing and bottom hole assembly. Drilling operations are initiated and instrument readings relayed by the cable, or other means to the computer at the earth's surface. The bottom hole assembly is oriented and reoriented down hole as may be required to comply with the guidance system to drill to the designated or desired target area. The orienting is accomplished by moving the coiled tubing longitudinally in or out of the well bore to move the mandrel accordingly either in or out of the tubular member 20 which rotates member 20. The grooves 16*a*, in the embodiments shown, extend on the mandrel 16 in a left hand direction so that lowering of the mandrel 16 by the coil tubing T into the member 20 rotates the member 20 to the right, and raising the coil tubing to move the mandrel 16 out of the member 20, turns the member to the left. The member 20 is rotated the amount dictated by the resulting information derived from the instrument readings to attain the required orientation of the down hole assembly. The lock 25 is then actuated by increasing pump pressure and volume to move the piston means 24 so that the slip means 21 overcomes the spring force of spring 31 normally maintaining the slips retracted and then the slips engage the mandrel 16 and member 20 to lock them together to maintain the desired oriented drilling direction.

When it is desired to reorient, the lock must be first released by relieving pump pressure or shutting off fluid pressure to relieve the force acting on the piston. If this does not release the mandrel and member for relative movement, the assembly is picked up off bottom and gently tapped or bumped on the well bore bottom to enable the spring to act to release the lock 25. The reorientation is then accomplished as described above, the lock 25 is actuated by fluid pressure to engage mandrel 16 and member 20 and drilling operations continued.

Figure 4B:
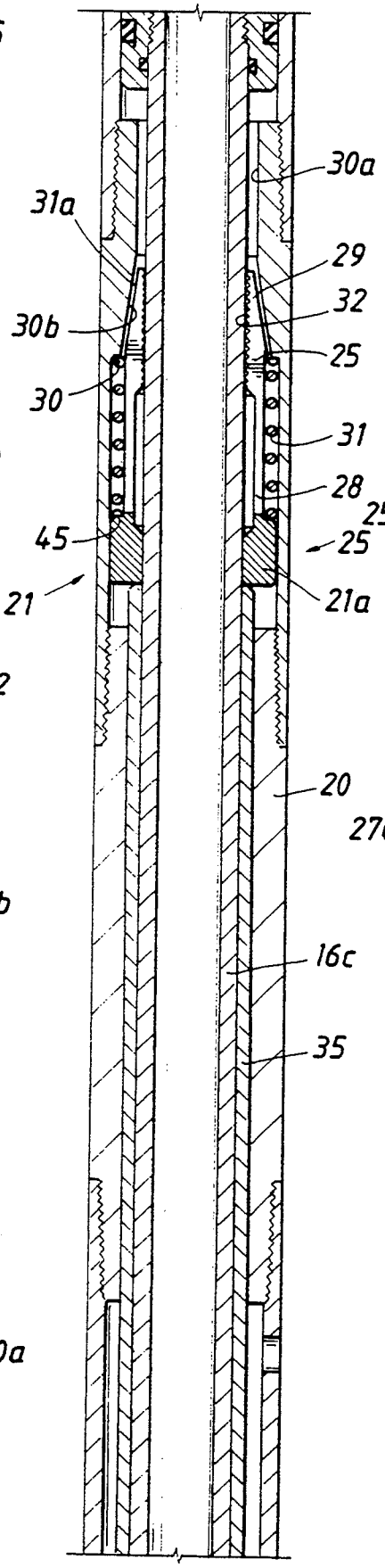
Figure 4C:
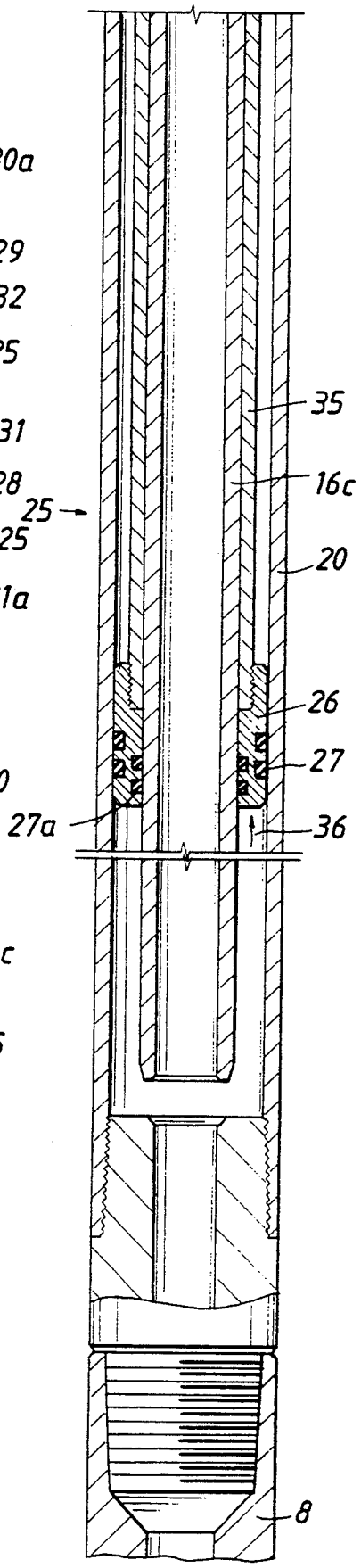

Attention is next directed to FIGS. 4A, 4B and 4C wherein like numerals represent like components to that described with regard to FIGS. 2 and 3.

FIGS. 4A–4C represent another form of the invention and illustrate such form in closed and unlocked position. Seal means 40 are provided between mandrel 16 and tubular member 20 to inhibit the entry of debris or well fluid between mandrel 16 and member 20. Lock means 25 includes piston 26 on mandrel 16 which piston is sealably engaged in the bore of member 20 by seals 27 as shown in FIG. 4C.

The piston means 24 in this embodiment also includes slip means 21 since tubular piston extension 35 is connected to piston 26 in any suitable manner as shown in FIG. 4C. The extension 35 extends within the tubular member 20 and surrounds the reduced outer diameter extension **16*c* of the rotator or tubular mandrel 16 to abut and support the slip means 21 in longitudinally spaced relationship relative to the piston 24 as shown in FIGS. 4B, 4C. This arrangement enables the slip segments 29 to engage a portion on the extension 16*c* of the mandrel spaced from the portion of the mandrel engaged by the seals 27*a* as better seen in FIG. 4C**.

The slip means 21 includes an annular base **21*a* from which extend the slip arms 28 with annular slip segments 29 thereon. The slip segments 29 are provided with an annular tapered surface 31*a* on one side for engaging the annular tapered counterbore 30*b* adjacent the shoulder 30 surrounding the opening 30*a* formed in the member 20, and another side surface 32, which surface 32 is serrated as shown to provide a better grip for engaging with the annular surface on the reduced extension 16*c* of the rotator mandrel 16. The spring 31 extends between the shoulder 45 on the base 21*a* and the shoulder 30 on the member 20**.

Assembly and operation including orientation and reorientation of the bottom hole assembly including the bent sub, down hole motor and drill bit is accomplished as described with regard to the FIGS. 2 and 3 embodiment. Longitudinal movement of the coil tubing T moves the mandrel 16 and this rotates the member 20 to accomplish the desired orientation as dictated by the steering operator at the earth's surface, in a manner as described with regard to the FIGS. 2 and 3 embodiment.

After the orientation has been accomplished, the lock means 25 may be actuated to lock mandrel and member 20 in their oriented or relatively rotated relationship. When fluid pressure in coil tubing T is increased sufficiently to overcome the spring force of the spring 30, the piston 26 is moved upwardly by fluid pressure and volume from the coil tubing acting on the lower end of the piston 26 as represented by the arrow 36 between the member 20 and reduced diameter extension **16*c* as shown in FIG. 4C so that the annular tapered surface 31*a* on one surface side of slip annular or arcuate slip segments 29 engages tapered annular surface 30*b* in opening 30*a* of member 20 and the other surface 32 on the other side of slip segments 29, which surface is serrated, engages the outer surface of extension 16*c* of mandrel 16. This locks the mandrel 16 and member 20** together to prevent relative longitudinal movement therebetween and maintains the orientation of the down hole assembly including bent sub, down hole motor and drill bit. Fluid pressure and volume in the coiled tubing is then increased, or maintained at a pressure desired to operate the down hole motor which rotates the drill bit to drill the well bore in the direction dictated by the orientation provided by the steering system.

The grooved mandrel 16 and member 20 remain locked by the lock means 25 until the target area is drilled into or until it is desirable to disengage them for repositioning them relative to each other to rotate for orienting the downhole motor, bent sub and drill bit face in an adjusted position to assure that the well bore is drilled to penetrate the target area as desired. To accomplish repositioning, the lock means is released by reducing the fluid pressure that is conducted through the coiled tubing and into the bottom hole assembly and out the down hole motor to rotate it and the bit. When the fluid pressure is reduced below the spring force on spring 30, the coiled tubing and down hole assembly with the drill bit on the lower end thereof may, if necessary, be lowered by the Injector Head E to bump or tap the drill bit on the bottom of the well bore just enough to jar the outer tubular member 20 relative to the grooved mandrel 16 so that the spring 30 may act to dislodge the slip segments 29 from engagement with the annular tapered surfaces on the tubular member and from engagement with the portion **16*b* of the grooved mandrel to accommodate longitudinal movement of the slips to return them to the released position shown in FIG. 4B**.

Figure 10:
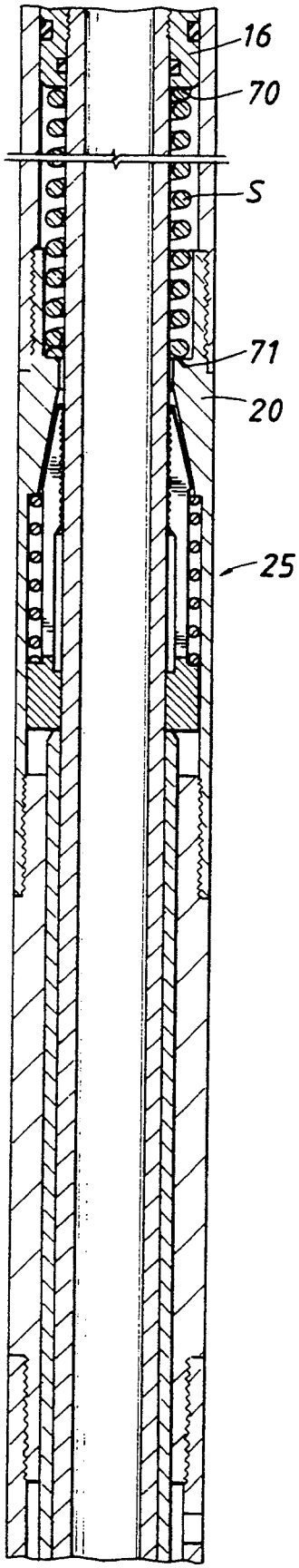
FIG. 10 is a sectional view like FIG. 4C with a spring inserted between the mandrel and the tubular member.

FIG. 10 illustrates an alternate form of the invention shown in FIGS. 4A–4C inclusive . It is the same except in FIG. 4B the spring S has been added as shown in FIG. 10 and is positioned between the shoulder 70 on mandrel or rotator 16 and the shoulder 71 on rotatable member 20 to assist in urging them apart after the lock 25 is released. The remainder of this embodiment is that as shown in FIGS. 4A and 4C. and the operation is similar to that as described with regard to the FIGS. 2 and 3 form of the invention with the spring functioning as described with regard to FIGS. 2 and 3. The spring S assists in maintaining the rotator or mandrel 16 and rotatable member 20 in a longitudinal spaced relationship until relative longitudinal movement therebetween occurs to overcome the force in spring S to collapse it as they telescope together toward a closed position until the desired oriented or rotated position of tubular member 20 is attained. It also assists in enabling successive orientations to be effected in the well bore as described herein.

Attention is now directed to the embodiment illustrated in FIGS. 5 through 7A, inclusive wherein like numerals are applied to like components described with regard to the embodiments of FIGS. 2 through 4C inclusive.

The assembly, operation and function of this embodiment is generally similar to that described with regard to the FIGS. 2–4C embodiments, and in this embodiment the engagement of the slips between the tubular member and the mandrel is modified; locking of the member 20 and mandrel 16 is prevented when they are fully collapsed together; and a second piston 60 on the mandrel 16 assists in locking tubular member 20 and tubular mandrel 16 together; and after the lock 25 between mandrel 16 and member 20 is released to accommodate relative movement between mandrel 16 and member 20, the piston 60 on the mandrel enables the mandrel 20 and member to be pumped apart, or recocked as will be described hereinafter.

Figure 5A:
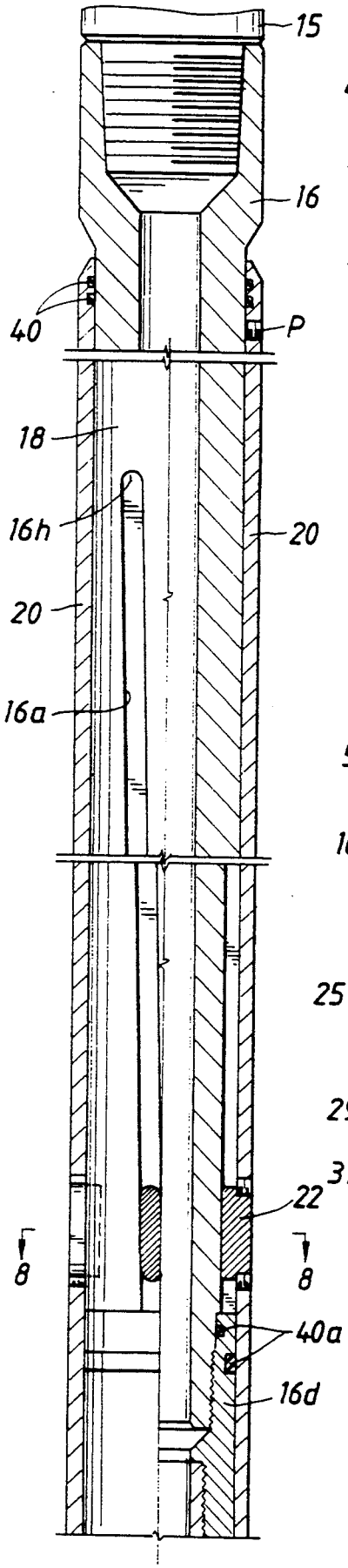
FIGS. 5A, 5B and 5C are continuation sectional views showing yet another embodiment of the present invention in closed or fully telescoped and unlocked position.
Figure 6A:
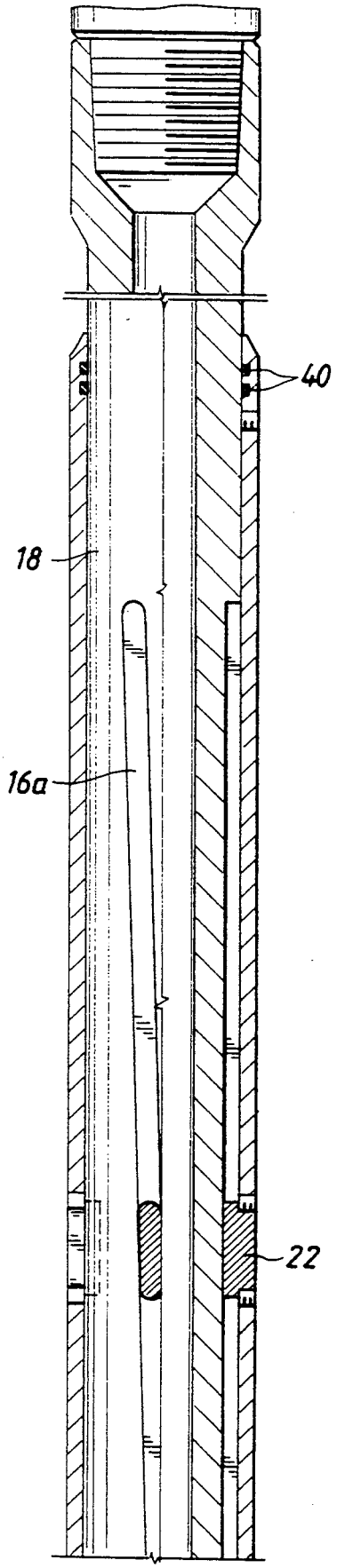
FIGS. 6A, 6B, 6C are continuation sectional views illustrating the form of the invention shown in FIGS. 5A–5C inclusive when it is in partially open and in unlocked position.
Figure 6B:
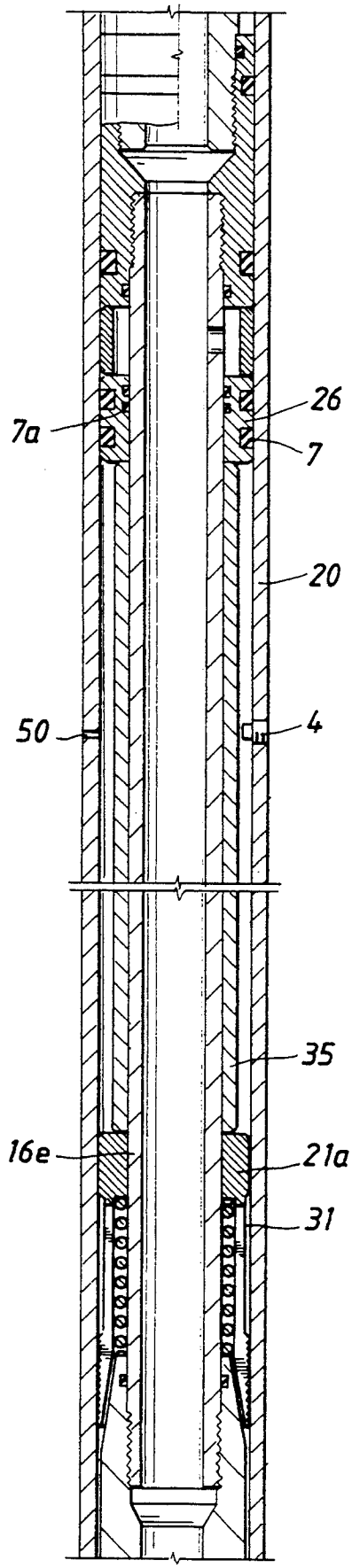
Figure 6C:
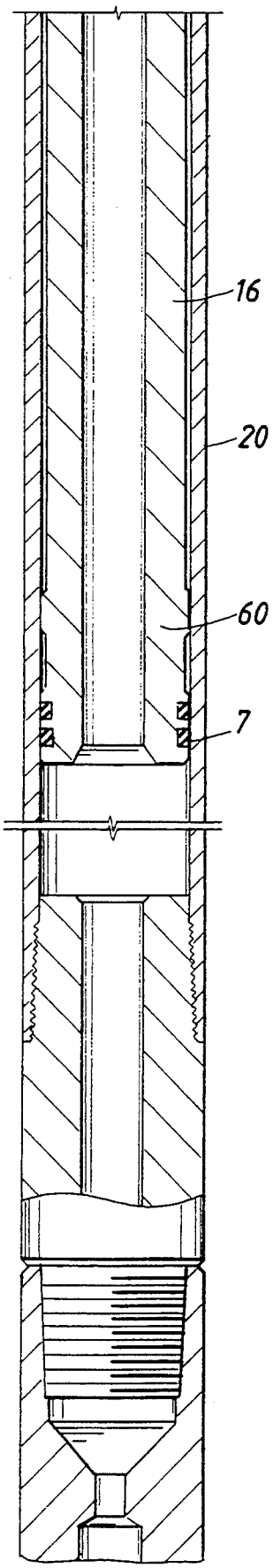
Figure 7A:
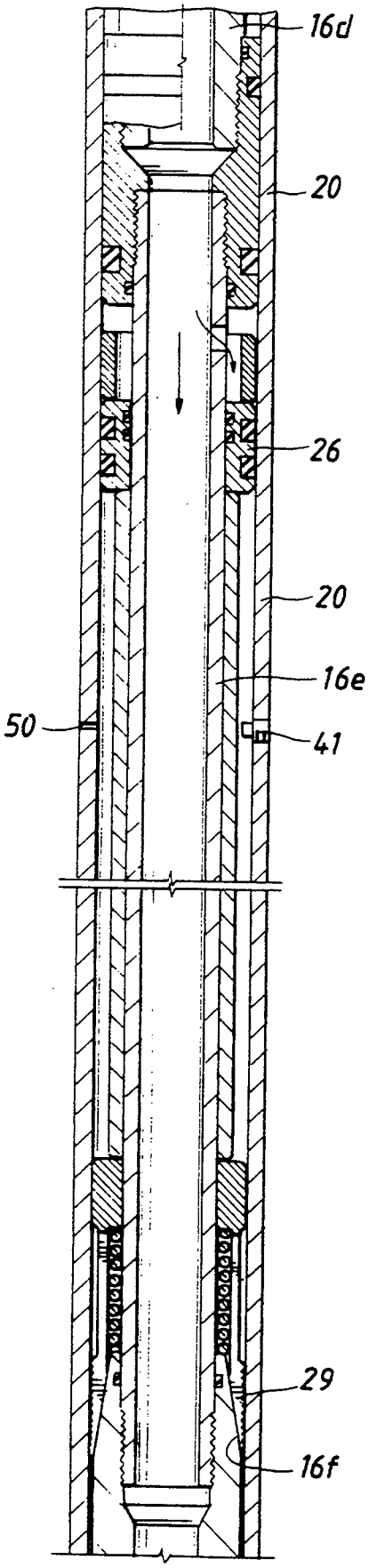
FIGS. 7A and 7B are continuation sectional views showing the form of the the invention in FIGS. 5A–5C partially open and in locked relationship.
Figure 7B:
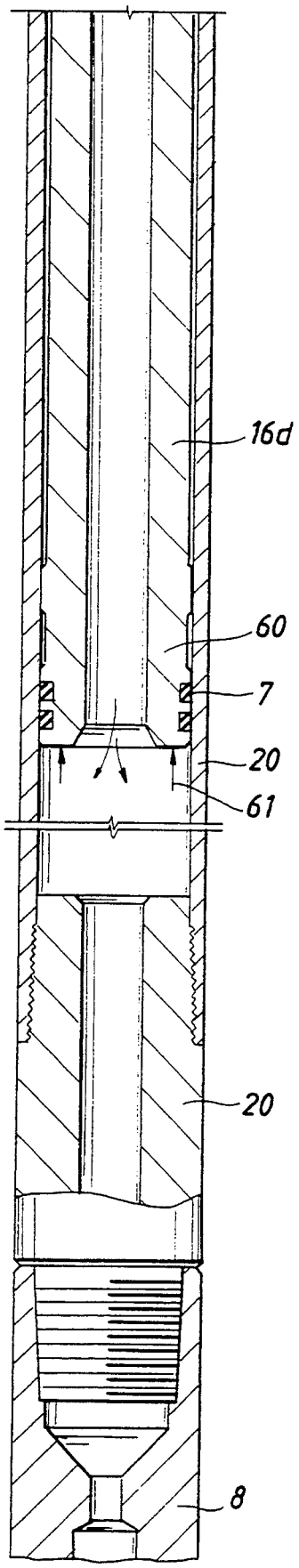

The mandrel 16 is provided with circumferentially spaced, longitudinally extending grooves **16*a* in which keys or members 22 on tubular member 20 engage. Seals 40 sealably engage between the mandrel 16 and member 20 as shown in FIG. 5A to prevent the entry of foreign substances into the orienting tool. The extension 16*d* of the mandrel 16 has a portion 16*e* which is reduced in outer diameter in relation to the diameter of the extension 16*d* as shown in FIGS. 5B, 6B and 7A**.

In this form, the piston means 24 includes first piston 26, a piston extension 35 and slip means 21 which provide the lock means 25. A second piston 60 is on the mandrel 16.

Figure 5B:
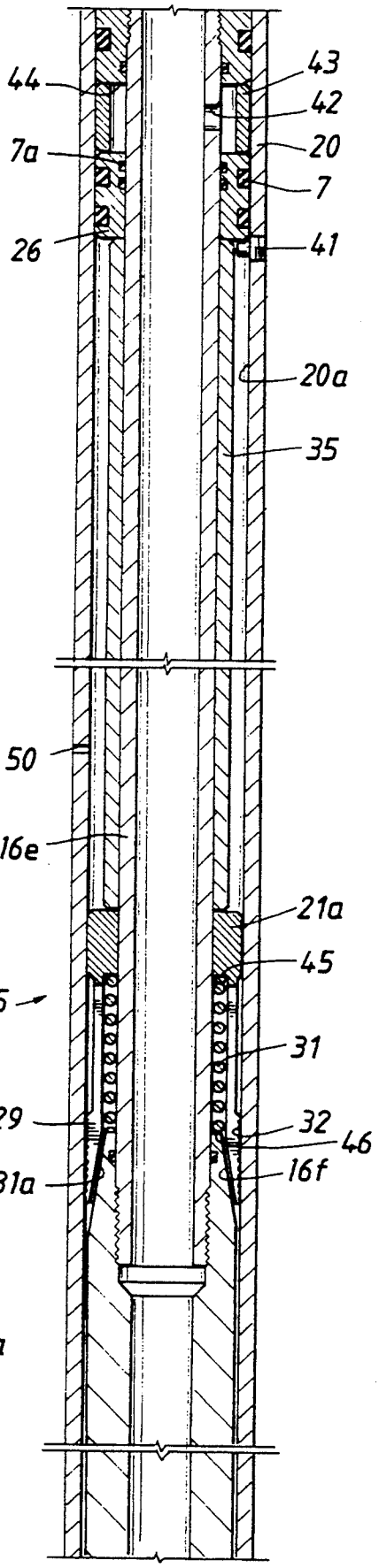
Figure 5C:
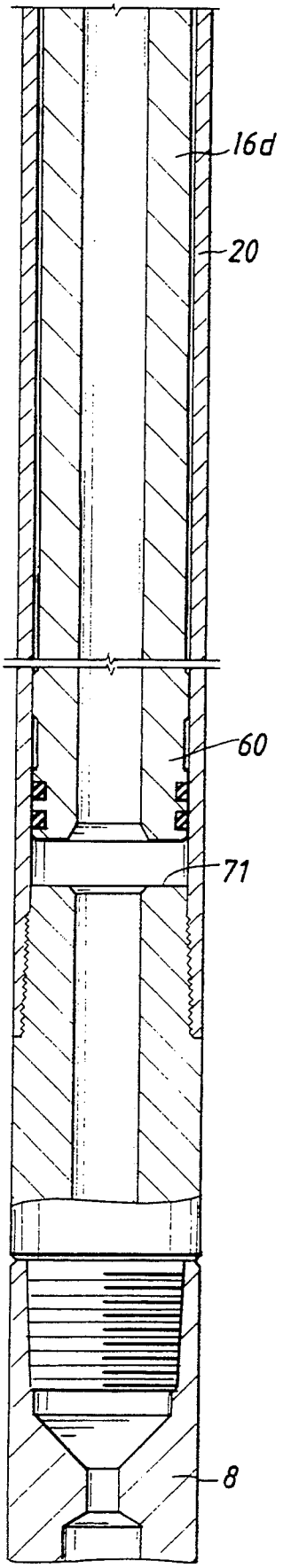

When the mandrel 16 and member 20 are fully collapsed as shown in FIGS. 5A–5C, the lower end of piston 26 abuts the projection 41 secured to member 20 which extends into the bore **20*a* as seen in FIG. 5B. This prevents any further movement of the piston means including piston 26, extension 35 and slip segments 29 of slip means 21 to prevent engagement of the slip segments with the tapered, annular surface 16*f* on the mandrel and with the inner wall defining bore 20*a* of member 20, so that the lock 25 is deactivated and cannot secure the mandrel 16 and member 20 together when they are fully collapsed together. Should member 20 and mandrel 16 be locked together by the lock 25** when they are fully collapsed, it would be difficult, if not impossible to release them in a well bore so that further orientation could be effected, if necessary.

The first piston 26 abuts and is supported on one end of the extension 35. A port 42 is in mandrel 16 adjacent the first piston 26, and a spacer 43 which may be considered a part of the mandrel or a part of the piston 26 spaces the first piston 26 relative to the shoulder 44 on the mandrel as shown. Sufficient fluid pressure from the mandrel flows through port 42 and acts on piston 26 to force it and extension 35 downwardly against the base **21*a* of the slip means 21. When the fluid pressure and volume acting on the piston 26 overcomes the spring force in spring 31, the spring collapses and permits the arcuate, tapered surface 31*a* on one side of the slip segments 29 to engage the tapered surface 16*f* on the mandrel and permits the other surface 32 on the other side of slip segments 29 to engage the inner wall of the member 20 to lock the mandrel 16 and tubular member 20 together after the member 20** has been rotated relative to the mandrel to orient the down hole directional equipment including the bent sub motor and drill bit, forming the bottom hole assembly, as desired.

After the mandrel 16 and member 20 are locked together with the slip segments 29 the fluid pressure and volume is maintained as required for drilling operations. This increased pressure acts between the lower end of second piston 60 and the adjacent spaced shoulder surface 71 in the member 20 to increase the locking effect or force of the slip segments with the mandrel 16 and the member 20 since the member acts to try to move down in response to the fluid pressure and volume. This urges the slip segments into tighter engagement with the mandrel 16 and member 20.

When it is desired to release the lock, the fluid pressure and volume in the coil tubing T and the mandrel 16 is reduced below the spring force of spring 31. The spring 31 is supported between shoulders 45 and 46 on the base of the slip means and on the mandrel, respectively, which tends to urge the slips away from the surface **16*f*** on the mandrel.

As shown in FIG. 5B, the stop 41 prevents the lock 25 from actuating when the mandrel is fully collapsed into the member 20 so that the orienting tool remains operative to reorient when necessary or desirable.

Due to the friction when the orienting tool OT is on its side in a deviated well bore including a horizontal well bore, it may be difficult, if not impossible even after both the mandrel 16 and member 20 are released from the slip segments 29 of the lock 25 to manipulate the mandrel 16 and member 20 for relative movement to recock the orienting tool.

Figure 11:
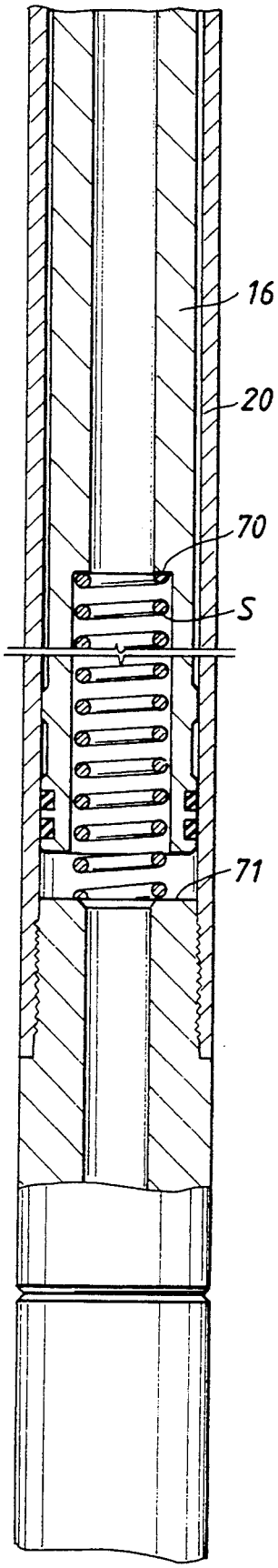
FIG. 11 is a sectional view like FIG. 5C with a spring inserted between the mandrel and the tubular member.

FIG. 11 shows an alternate form of the FIGS. 5–7B embodiment. It is the same except FIG. 11 shows FIG. 5C with a spring S between the mandrel 16 and tubular member 20. It assists in moving mandrel 16 and tubular member 20 apart after the lock 25 has been released, as described with regard to the FIGS. 2–4C embodiments. More specifically, the spring S is shown between the shouilder 70 on mandrel 16 and the shoulder 71 on the sub which is connected with and may be considered as part of the member 20.

In some situations, such as where lost circulation of the drilling fluid occurs in the well bore, it may be difficult if not impossible to pump the mandrel 16 and the member 20 apart. The spring 20 assists in moving them apart for another orientation as described with regard to all modifications.

In the FIGS. 5–7A embodiment, increased fluid pressure and volume will act between the end of second piston 60 and member 20 to pump the orienting tool OT to the recocked open, or extended position. This enables the present invention to be employed to reorient as previously described.

The larger diameter of the inner surface of the tubular member 20 enables the serrated surface of the larger arcuate slip segments 29 in the FIGS. 5–7A form to exert a better gripping engagement with the tubular member 20.

In FIGS. 4A and 5A a plug is provided for a lubricant opening through which lubricant may be provided between the spaced seals 40 and 40A.

The mandrel 16 and the member 20 of the embodiments shown may each be formed of tubular sections with suitable seals as shown for providing fluid integrity. Also suitable equalizing ports may be provided such as illustrated at 50 to equalize pressure between the assembly and the well bore.

Those skilled in the art of drilling well bores know from experience the fluid pressure and volume required to properly operate the well tool to accomplish its functions including the drilling operations described herein and when it is used in other well tool forms.

In the form of the invention described herein, the keys are on the tubular member and the grooves are on the tubular mandrel and it may be desirable in some situations to reverse their positions. As noted, orientation may be effected by telescopically collapsing the mandrel and the tubular member toward closed position or by telescopically extending or moving them apart.

The foregoing disclosure and description of the invention are illustrative and explanatory thereof, and various changes in arrangement, size, shape and materials as well as in the details of the illustrated construction may be made without departing from the spirit of the invention.

What is claimed is:

1. A well tool operable by a non rotatable, longitudinally movable well string extending into a well bore for rotating a down hole device, said well tool comprising:

a rotator for connection with the non rotatable well string to move longitudinally in the well bore in response to longitudinal movement of the non rotatable well string;

a rotatable member for telescopically receiving said rotator;

cooperating means on said rotator and said rotatable member for imparting rotation to said rotatable member and the down hole device upon longitudinal movement of the non rotatable well string and said rotator to telescope said rotator into said rotatable member: and a releasable lock to lock said rotator, said non rotatable well string and said rotatable member in a telescoped position to lock the device in a rotated position.

2. The well tool of claim 1 wherein the non rotatable well string is coiled tubing.

3. The well tool of claim 1 wherein:

said rotator is a tubular mandrel with a bore therethrough;

said rotatable member is a tubular member having a bore therethrough to telescopically receive said tubular mandrel; and wherein said cooperating means comprises:

longitudinally extending helical groove means on said tubular mandrel;

key means on said tubular member for engaging with said tubular mandrel groove means to impart rotation to said rotatable means upon longitudinal movement of the non rotatable well string and said rotator relative to said rotatable member.

4. The well tool of claim 1 wherein:

said rotator is a tubular mandrel with a bore therethrough;

said rotatable member is a tubular member having a bore therethrough for receiving said tubular mandrel;

key means on said tubular mandrel;

longitudinally extending helical groove means on said tubular member for engaging with said tubular mandrel key means to impart rotation to said rotatable member upon relative longitudinal movement between said rotator and said rotatable member.

5. The well tool of claim 1 wherein said releasable lock includes movable piston means and slip means movable by said movable piston means to engage and lock said rotatable member and said rotator connected with the well string together and wherein said rotatable member has an inner surface including an annular tapered portion and wherein said rotator has an outer surface.

6. The well tool of claim 1 including a centralizer on said rotator for maintaining alignment between said rotator and said rotatable member during relative longitudinal movement.

7. The well tool of claim 5 wherein said slid means is on said piston means.

8. The well tool of claim 7 wherein said rotatable member includes a first and a second shoulder and wherein:

said piston means is supported on said first shoulder; and spring means abutting between said piston means and said second shoulder to normally maintain said slip means retracted from locking engagement with said rotator and said rotatable member.

9. The well tool of claim 5 wherein said slip means includes annular slip segments and said slip means is integral with said piston means.

10. The well tool of claim 5 wherein said slip means includes annular slip segments and said slip means is supported by said rotator.

11. The well tool of claim 5 wherein said movable piston means sealably engages with the inner surface of said tubular member and with the outer surface of said tubular mandrel.

12. The well tool of claim 5 wherein said slip means includes annular slip segments with annular tapered surface means on one side and another surface on the the other side of said slip segments for engaging with the annular tapered surface means on said rotatable member and with the outer surface of said rotator.

13. The well tool of claim 5 wherein said slip means includes annular slip segments with annular tapered surface means on one side and another surface on the other side for engaging, respectively, with an annular tapered surface on said rotator and with the inner surface of said rotatable member.

14. The well tool of claim 13 wherein said annular slip segment surfaces which engage the outer surface of said rotator are serrated.

15. The well tool of claim 5 including a shoulder on said rotator and a spring abutting between said shoulder and said slip means.

16. The well tool of claim 5 wherein;

said piston means includes a piston;

a tubular extension for supporting said piston through which extension said rotator extends;

said slip means include a base;

slip arms extending from said base;

slip segments on said arms; and spring means to normally maintain said slip means disengaged from locking engagement with said rotator and rotatable member.

17. The well tool of claim 16 wherein said spring means abuts between said slip means base and rotatable member to normally maintain said slip means disengaged from locking engagement with said rotator and rotatable member.

18. The well tool of claim 16 wherein said spring means abuts between said slip means base and rotator to normally maintain said slip means disengaged from locking engagement with said rotator and rotatable member.

19. The apparatus of claim 1 wherein said rotator has a piston secured thereon sealably engaging with said rotatable member.

20. The apparatus of claim 2 wherein said rotator has a piston secured thereon sealably engaging with said rotatable member.

21. The apparatus of claim 3 wherein said rotator has a piston secured thereon sealably engaging with said rotatable member.

22. The apparatus of claim 1 including a spring between said rotatable member and rotator.

23. The apparatus of claim 2 including a spring for urging said rotatable member and rotator apart when they are not locked together by said releasable lock.

24. The apparatus of claim 3 including a spring between said rotatable member and said tubular mandrel.

25. The apparatus of claim 4 including a spring for urging said rotatable member and said rotator apart when they are not locked together by said releasable lock.

26. The apparatus of claim 5 including a spring for urging said rotatable member and said rotator apart when they are not locked together by said releasable lock.

27. The apparatus of claim 6 including a spring between said rotatable member and said tubular mandrel.

28. The apparatus of claim 7 including a spring for urging said rotatable member and said rotator apart when they are not locked together by said releasable lock.

29. The apparatus of claim 8 including a spring for urging said rotatable member and said rotator apart when they are not locked together by said releasable lock.

30. The apparatus of claim 9 including a spring for urging said rotatable member and said rotator apart when they are not locked together by said releasable lock.

31. The apparatus of claim 10 including a spring for urging said rotatable member and said rotator apart when they are not locked together by said releasable lock.

32. The apparatus of claim 11 including a spring for urging said rotatable member and said rotator apart when they are not locked together by said releasable lock.

33. The apparatus of claim 12 including a spring between said rotatable member and said tubular mandrel.

34. The apparatus of claim 13 including a spring between said rotatable member and said rotator.

35. The apparatus of claim 14 including a spring between said rotatable member and said rotator.

36. The apparatus of claim 15 including a spring between said rotatable member and said rotator.

37. The apparatus of claim 16 including a spring between said rotatable member and said rotator.

38. The apparatus of claim 17 including a spring between said rotatable member and said rotator.

39. The apparatus of claim 18 including a spring between said rotatable member and said rotator.

40. The apparatus of claim 19 including a spring for urging said rotatable member and said rotator apart.

41. The apparatus of claim 20 including a spring for urging said rotatable member and said rotator apart.

42. The apparatus of claim 21 including a spring for urging said rotatable member and said tubular mandrel apart.

43. The orienting tool of claim 23 including a spring for urging said first member and said second member apart.

44. Apparatus for guiding and drilling a well bore to a desired target area with a non rotatable, longitudinally movable drill string comprising:

directional drilling equipment including a drilling member to guide the drilling member to drill the well bore;

instruments associated with said directional drilling equipment to determine the azimuth, inclination and direction of the tool face of said directional drilling equipment;

surface means to receive the instrument determinations of azimuth, inclination and tool face;

relay means to conduct said instrument determinations to the earth's surface; and an orienting well tool connected with the non rotatable, longitudinally movable drill string and with said directional drilling equipment, including the drilling member to orient said directional drilling equipment including the drilling member to a predetermined position upon longitudinal movement of the non rotatable, longitudinally movable drill string to position the drilling member to drill the well bore to the desired target area.

45. The apparatus of claim 44 wherein said orienting well tool includes:

a tubular mandrel connected with the non-rotatable, longitudinally movable drill string and depending therefrom;

a rotatable member for telescopically receiving said tubular mandrel; and cooperating means associated with said rotatable member and with said tubular mandrel for imparting rotation to the rotatable member upon longitudinal movement of the longitudinally movable drill string arid said tubular mandrel relative to said rotatable member to position the drilling member for drilling to the desired target area.

46. The apparatus of claim 45 including stop means to limit the telescoping relation of said rotatable member and said tubular mandrel and wherein the cooperating means accommodate not less than 360 degrees of rotation of said rotatable member relative to said mandrel.

47. The apparatus of claim 44 wherein said orienting well tool includes:

a tubular mandrel connected with the non-rotatable, longitudinally movable drill string and depends therefrom;

a rotatable member telescopically receiving said tubular mandrel; and cooperating means on said tubular mandrel and said rotatable member to rotate said rotatable member upon longitudinal movement of the non rotatable well string.

48. The apparatus of claim 45 wherein said orienting tool includes a spring between said rotatable member and said tubular mandrel.

49. The apparatus of claim 47 including a spring between said rotatable member and said tubular mandrel.

50. In an orienting tool for connection between a well string and a device to orient the device by longitudinal movement of the well string to a predetermined position in a well bore, the invention comprising:

a first member for connection with the well string;

a second member for connection with the device and telescopically receiving said first member;

a releasable lock to lock said first member and said second member together in the predetermined position; and a spring between said first member and said second member to inhibit premature actuation of said lock means.

51. The orienting tool of claim 50 including cooperating means on said first member and on said second member responsive to longitudinal movement of the well string and said first member to orient the device in the well bore to the predetermined position.

52. The orienting tool of claim 51 wherein said cooperating means comprises helical groove means on one of said member and keys on the other of said members to engage the helical grooves means on said one member.

53. The apparatus of claim 50 wherein one of said members has a piston secured thereon sealably engaging with the other of said members.

54. The orienting tool of claim 50 including a spring for urging said first member and said second member apart when they are not locked together by said releasable lock.

55. The orienting tool of claim 51 including a spring for urging said one and other members apart when they are not locked together by said releasable lock.

56. The orienting tool of claim 52 including a spring for urging said first member and said second member apart when they are not locked together by said releasable lock.

57. In a rotatable tool for connection between a coiled tubing well string and a device to be oriented in a well bore the invention including:

first and second members telescopically engageable, with one of said members engageable with the coiled tubing well string and the other member engageable with the device to be oriented in the well bore;

cooperating means on said first and second members to effect rotation of said member connected with the device to be oriented upon longitudinal movement of the coiled tubing well string and the member connected therewith to position the device in a predetermined rotated position; and lock means to lock said first and second members together in the predetermined rotated position.

58. The orienting tool of claim 57 wherein said lock means includes piston means and slip means movable by said piston means to lock with said first and second members to retain them in the rotated position.

59. The orienting tool of claim 57 including piston means on one of said members which is responsive to fluid pressure to move said first and second members apart when substantially fully telescoped together.

60. The orienting tool of claim 57 including limit means to stop the telescoping together of said first and second members when said first and second members are substantially fully telescoped together to prevent actuation of said lock means.

61. The rotatable tool of claim 57 including a spring for urging said first member and said second member apart when said first member and said second members are not locked together by said lock means.

62. A releasable lock for a down hole well tool for rotating a device in a well bore, which tool has a first non rotatable member for connection with a non-rotatable well string and a second rotatable member for connection with the device to be rotated including:

a piston;

seal means for sealably engaging said piston between the first and second members; and slip means associated with said piston means movable in response to movement of said piston means to secure the first and second members together.

63. A method of assembling apparatus for drilling a well bore with a non rotatable longitudinally movable, drill string wherein the apparatus includes down hole directional drilling equipment including a drilling member forming a bottom hole assembly, instruments for determining the azimuth, inclination and direction of the tool face of the bottom hole assembly, surface equipment for receiving the instrument determinations, relay means for relaying the instrument determinations to the surface equipment and a down hole well tool having a non rotatable member telescopically engageable with a rotatable member, the well tool operable by moving the nonrotatable longitudinally movable drill string to rotate the down hole directional drilling equipment including a drilling member and to lock the non rotatable member and the rotatable member together to guide drilling the well bore to a target area comprising the steps of:

connecting the rotatable member of the well tool with the down hole directional drilling equipment including a drilling member; and connecting the non rotatable member of the well tool with the non-rotatable longitudinally movable drill string.

64. A method of orienting a bottom hole assembly in a well bore with a non-rotatable drill string to drill a well bore to a desired target area wherein the bottom hole assembly includes directional drilling equipment including a fluid actuated motor and a drilling member operable thereby to drill the well bore to drill a well bore to a desired target area instruments for determining the azimuth, inclination and direction of the tool face of the bottom hole assembly, surface equipment for receiving the instrument determinations, relay means for relaying the instrument determinations to the surface equipment, a down hole orienting well tool having first and second members telescopically engageable, with one of said members engageable with the non rotatable, longitudinally movable well string and the other member engageable with the bottom hole assembly to be oriented in the well bore and cooperating means on the first and second members to effect rotation of the member connected with the bottom hole assembly to be oriented and a lock normally retained by a spring in unlocked relation to the first and second members but responsive to fluid pressure in the orienting well tool to lock the first and second members together in a predetermined oriented position comprising the steps of:

lowering the drill string with the well tool and bottom hole assembly including the directional drilling equipment including a fluid actuated motor and drilling member actuated thereby into the well bore;

relaying to the surface equipment information from the instruments;

manipulating the drill string longitudinally and the member connected therewith longitudinally to rotate the member connected with the bottom hole assembly directional drilling equipment including a fluid actuated motor and drilling member actuated thereby relative to the member connected to the drill string to orient the bottom hole assembly to position the directional drilling equipment including a fluid actuated motor and drilling member actuated thereby to drill the well bore to the target area;

supplying fluid pressure to the motor to actuate the drilling member to drill the well bore; and moving the non rotatable, longitudinally movable drill string in the well bore.

65. The method of claim 64 including the steps of increasing the fluid pressure in the non rotatable, longitudinally movable well string and orienting well tool to overcome the spring so that the lock secures the first and second members together.

66. The method of claim 65 including the step of releasing the lock by decreasing the fluid pressure in the non rotatable, longitudinally movable well string and orienting well tool to enable the spring to disengage the lock from the first and second members.

67. The method of claim 66 including the step of bumping the drill member on the bottom of the well bore to assist in releasing the lock means.

68. The method claim 66 including the step of manipulating the non-rotatable, longitudinally movable drill string and the member connected therewith to move the member connected with the drill string outwardly of the member connected with the bottom hole assembly.

69. The method of claim 68 including the step of lowering the member connected with the longitudinally movable drill string to move it into the member connected with the bottom hole assembly to reorient the bottom hole assembly to another oriented position.

70. The method claim 67 including the step of manipulating the non-rotatable, longitudinally movable drill string and the member connected therewith to move the member connected with the drill string outwardly of the member connected with the bottom hole assembly.

71. The method of claim 70 including the step of lowering the member connected with the drill string to move it into the member connected with the bottom hole assembly to reorient the bottom hole assembly to another desired position.

72. The method of claim 65 wherein seal means are provided between the first and second members, and including the step of providing fluid pressure to pump the member connected to the drill string outwardly relative to the member connected to the drilling member.

73. The method claim of 72 including the step of raising the non-rotatable, longitudinally movable drill string and the member connected therewith to move the member connected with the drill string outwardly of the member connected with the directional drilling equipment, including a fluid actuated motor and drilling member actuated thereby.

74. The method of claim 72 including the step of lowering the non rotatable, longitudinally movable drill string and the member connected therewith to move it into the member connected with the bottom hole assembly to rotate the bottom hole assembly.

75. A method of orienting a device to at least one position in a well bore by a well string which is connected to one member of a down hole orienting tool with the device connected to to at least one other member of the down hole orienting tool, the members including cooperating means operable by manipulation of the well string to rotate the member connected to the device relative to the well string and a releasable, fluid actuated lock to lock the members in the position to which the device is oriented, comprising the steps of:

lowering the well string with the members and the device into the well bore;

lowering the well string with the one member connected therewith to rotate the device connected with the other member to a predetermined oriented position; and locking the members together in the oriented position.

76. The method of claim 75 including the steps of:

unlocking the lock and manipulating the well string to rotate and lock the members and device in another oriented position.

* * * * *

UNITED STATES PATENT AND TRADEMARK OFFICE

CERTIFICATE OF CORRECTION

PATENT NO. : 5,339,913

DATED : August 23, 1994

INVENTOR(S) : Allen K. Rives

It is certified that error appears in the above-identified patent and that said Letters Patent is hereby corrected as shown below:

In Column 13, Line 17, insert a hyphen between "non" and "rotatable".
In Column 13, Line 20, insert a hyphen between "non" and "rotatable".
In Column 13, Lines 22-23, insert a hyphen between "non" and "rotatable".
In Column 13, Line 29, insert a hyphen between "non" and "rotatable".
In Column 13, Lines 32-33, insert a hyphen between "non" and "rotatable".
In Column 13, Line 36, insert a hyphen between "non" and "rotatable".
In Column 14, Line 9, delete "slid" and insert therefor --slip--.
In Column 14, Line 31, insert --an-- between "with" and "annular".
In Column 14, Line 32, delete "surface means" and insert therefor --portion--.
In Column 14, Line 33, insert --, respectively,-- between "engaging" and "with".
In Column 14, Line 34, delete "the" and insert therefor --said--.
In Column 14, Line 34, delete "surface means" and insert therefor --portion--.
In Column 14, Line 35, delete "the" and insert therefor --said--.
In Column 14, Lines 50-51, before "a tubular" insert --said rotor includes-- and delete "through which extension said rotator extends".
In Column 15, Line 1, delete "apparatus" and insert therefor --well tool--.
In Column 15, Line 4, delete "apparatus" and insert therefor --well tool--.
In Column 15, Line 7, delete "apparatus" and insert therefor --well tool--.
In Column 15, Line 10, delete "apparatus" and insert therefor --well tool--.
In Column 15, Line 12, delete "apparatus" and insert therefor --well tool--.
In Column 15, Line 15, delete "apparatus" and insert therefor --well tool--.
In Column 15, Line 17, delete "apparatus" and insert therefor --well tool--.
In Column 15, Line 21, delete "apparatus" and insert therefor --well tool--.
In Column 15, Line 25, delete "apparatus" and insert therefor --well tool--.
In Column 15, Line 27, delete "apparatus" and insert therefor --well tool--.
In Column 15, Line 31, delete "apparatus" and insert therefor --well tool--.
In Column 15, Line 35, delete "apparatus" and insert therefor --well tool--.
In Column 15, Line 39, delete "apparatus" and insert therefor --well tool--.
In Column 15, Line 43, delete "apparatus" and insert therefor --well tool--.
In Column 15, Line 47, delete "apparatus" and insert therefor --well tool--.
In Column 15, Line 49, delete "apparatus" and insert therefor --well tool--.
In Column 15, Line 51, delete "apparatus" and insert therefor --well tool--.
In Column 17, Line 3, begin a new paragraph at "a spring".

UNITED STATES PATENT AND TRADEMARK OFFICE

CERTIFICATE OF CORRECTION

PATENT NO. : 5,339,913

DATED : August 23, 1994

INVENTOR(S) : Allen K. Rives

It is certified that error appears in the above-identified patent and that said Letters Patent is hereby corrected as shown below:

In Column 15, Line 53, delete "apparatus" and insert therefor --well tool--.
In Column 15, Line 55, delete "apparatus" and insert therefor --well tool--.
In Column 15, Line 57, delete "apparatus" and insert therefor --well tool--.
In Column 15, Line 59, delete "apparatus" and insert therefor --well tool--.
In Column 15, Line 61, delete "apparatus" and insert therefor --well tool--.
In Column 15, Line 63, delete "apparatus" and insert therefor --well tool--.
In Column 15, Line 65, delete "apparatus" and insert therefor --well tool--.
In Column 16, Line 5, insert a hyphen between "non" and "rotatable".
In Column 16, Lines 18-19, insert a hyphen between "non" and "rotatable".
In Column 16, Line 24, insert a hyphen between "non" and "rotatable".
In Column 16, Line 38, delete "arid" and insert therefor --and--.
In Column 16, Line 55, insert a hyphen between "non" and "rotatable".
In Column 17, Line 5, insert --releasable-- between "said" and lock".
In Column 17, Line 13, delete "member" and insert therefor --members--.
In Column 17, Line 14, delete "grooves" and insert therefor --groove--.
In Column 17, Line 15, delete "apparatus" and insert therefor --orienting tool--.
In Column 17, Line 45, delete "orienting" and insert therefor --rotatable--.
In Column 17, Line 49, delete "orienting" and insert therefor --rotatable--.
In Column 17, Line 53, delete "orienting" and insert therefor --rotatable--.
In Column 17, Line 60, delete "members" and insert therefor --member--.
In Column 17, Line 64, insert a hyphen between "non" and "rotatable".
In Column 18, Line 7, insert a hyphen between "non" and "rotatable".
In Column 18, Line 16, insert a hyphen between "non" and "rotatable".
In Column 18, Line 18, delete "nonrotatable" and insert therefor --non-rotatable--.
In Column 18, Line 20, insert a hyphen between "non" and "rotatable".
In Column 18, Line 27, insert a hyphen between "non" and "rotatable".
In Column 18, lines 43-44, insert a hyphen between "non" and "rotatable".
In Column 19, Line 7, insert a hyphen between "non" and "rotatable".
In Column 19, Line 10, insert a hyphen between "non" and "rotatable".
In Column 19, Line 16, insert a hyphen between "non" and "rotatable".
In Column 20, Line 15, insert a hyphen between "non" and "rotatable".

UNITED STATES PATENT AND TRADEMARK OFFICE

CERTIFICATE OF CORRECTION

PATENT NO. : 5,339,913 Page 3 of 3

DATED : August 23, 1994

INVENTOR(S) : Allen K. Rives

It is certified that error appears in the above-indentified patent and that said Letters Patent is hereby corrected as shown below:

In Column 20, Line 22, delete the second "to" in "to to"

Signed and Sealed this

Sixth Day of December, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,339,913
DATED : August 23, 1994
INVENTOR(S) : Allen K. Rives

It is certified that error appears in the above-indentified patent and that said Letters Patent is hereby corrected as shown below:

In Column 18,Line 35,delete "to drillthe well bore"--.

Signed and Sealed this

Twenty-first Day of February, 1995

*Attest:*

Bruce Lehman

BRUCE LEHMAN

*Attesting Officer*

*Commissioner of Patents and Trademarks*